US011021961B2

(12) United States Patent
Rambo et al.

(10) Patent No.: US 11,021,961 B2
(45) Date of Patent: Jun. 1, 2021

(54) ROTOR ASSEMBLY THERMAL ATTENUATION STRUCTURE AND SYSTEM

(71) Applicant: General Electric Company, Schenectady, NY (US)

(72) Inventors: Jeffrey Douglas Rambo, Mason, OH (US); Kirk Douglas Gallier, Liberty Township, OH (US); Brandon Wayne Miller, Liberty Township, OH (US); Craig Alan Gonyou, Blanchester, OH (US); Kevin Robert Feldmann, Mason, OH (US); Justin Paul Smith, Montgomery, OH (US)

(73) Assignee: General Electric Company, Schenectady, NY (US)

( * ) Notice: Subject to any disclaimer, the term of this patent is extended or adjusted under 35 U.S.C. 154(b) by 64 days.

(21) Appl. No.: 16/210,314

(22) Filed: Dec. 5, 2018

(65) Prior Publication Data

US 2020/0182059 A1 Jun. 11, 2020

(51) Int. Cl.
*F01D 5/08* (2006.01)
*F01D 5/18* (2006.01)

(52) U.S. Cl.
CPC ..... *F01D 5/081* (2013.01); *F01D 5/187* (2013.01); *F05D 2240/81* (2013.01); *F05D 2260/201* (2013.01)

(58) Field of Classification Search
CPC ..... F01D 5/081; F01D 5/082; F01D 5/087; F01D 5/187; F01D 5/3007; F05D 2240/81; F05D 2260/201; F05D 2260/204; F05D 2260/205
See application file for complete search history.

(56) References Cited

U.S. PATENT DOCUMENTS

| | | | | |
|---|---|---|---|---|
| 2,999,668 | A | 9/1961 | Howald et al. | |
| 5,135,354 | A * | 8/1992 | Novotny | F01D 5/3069 415/115 |
| 5,320,485 | A | 6/1994 | Bourguignon et al. | |
| 6,960,060 | B2 * | 11/2005 | Lee | F01D 5/081 415/115 |
| 6,981,841 | B2 * | 1/2006 | Krammer | F01D 5/082 415/115 |
| 7,059,825 | B2 | 6/2006 | Magowan et al. | |
| 7,131,817 | B2 | 11/2006 | Keith et al. | |
| 7,497,661 | B2 | 3/2009 | Boury et al. | |
| 7,520,724 | B2 | 4/2009 | Naik et al. | |
| 7,926,289 | B2 * | 4/2011 | Lee | F01D 5/081 415/145 |
| 9,188,011 | B2 | 11/2015 | Khanin | |
| 9,664,051 | B2 * | 5/2017 | Bluck | F01D 5/187 |
| 9,920,627 | B2 | 3/2018 | Snyder et al. | |

(Continued)

*Primary Examiner* — Brian P Wolcott
(74) *Attorney, Agent, or Firm* — Dority & Manning, P.A.

(57) ABSTRACT

An aspect of the present disclosure is directed to a rotor assembly for a turbine engine. The rotor assembly includes an airfoil assembly and a hub to which the airfoil assembly is attached. A wall assembly defines a first cavity and a second cavity between the airfoil assembly and the hub. The first cavity and the second cavity are at least partially fluidly separated by the wall assembly. The first cavity is in fluid communication with a flow of first cooling fluid and the second cavity is in fluid communication with a flow of second cooling fluid different from the first cooling fluid.

22 Claims, 7 Drawing Sheets

(56) References Cited

U.S. PATENT DOCUMENTS

| | | | | |
|---|---|---|---|---|
| 9,920,647 | B2 | 3/2018 | Jones et al. | |
| 10,107,109 | B2 * | 10/2018 | McCaffrey | F01D 5/187 |
| 2016/0237905 | A1 * | 8/2016 | Suciu | F02C 3/04 |
| 2018/0045054 | A1 | 2/2018 | Sehra et al. | |
| 2018/0066523 | A1 | 3/2018 | Marsh et al. | |
| 2018/0094527 | A1 | 4/2018 | Halfmann et al. | |

* cited by examiner

ROTOR ASSEMBLY THERMAL ATTENUATION STRUCTURE AND SYSTEM

FIELD

The present subject matter relates generally to rotor assembly thermal attenuation and flow structures for heat engines.

BACKGROUND

Heat engines, such as gas turbine engines, generally include cooling structures to provide cooling fluid to turbine blades to reduce wear and deterioration. However, known structures and systems for providing cooling fluid to turbine blades often result in inefficiencies due to large pressure drops and high temperatures related to the cooling fluid and the cooling fluid source. As such, there is a need for structures and systems for improving provision of cooling fluid to turbine blades while mitigating losses and inefficiencies at the engine related to providing cooling fluid.

BRIEF DESCRIPTION

Aspects and advantages of the invention will be set forth in part in the following description, or may be obvious from the description, or may be learned through practice of the invention.

An aspect of the present disclosure is directed to a rotor assembly for a turbine engine. The rotor assembly includes an airfoil assembly and a hub to which the airfoil assembly is attached. A wall assembly defines a first cavity and a second cavity between the airfoil assembly and the hub. The first cavity and the second cavity are at least partially fluidly separated by the wall assembly. The first cavity is in fluid communication with a flow of first cooling fluid and the second cavity is in fluid communication with a flow of second cooling fluid different from the first cooling fluid.

In one embodiment, the wall assembly is extended from the airfoil assembly or the hub to define a seal assembly defining the first cavity and the second cavity.

In another embodiment, the wall assembly is extended from the airfoil assembly between a static assembly and the rotor assembly to define a plenum therewithin in fluid communication with one or more of the first cavity or the second cavity.

In various embodiments, the rotor assembly includes a wall within the airfoil assembly defining a first plenum fluidly separated from a second plenum. In one embodiment, the first plenum is in fluid communication with the first cavity, and the second plenum is in fluid communication with the second cavity.

In one embodiment, the rotor assembly defines a first inlet opening through a base portion of the airfoil assembly in fluid communication with the first cavity.

In various embodiments, the airfoil assembly includes a plurality of circuits in fluid communication with one or more of the first cavity and the second cavity. In one embodiment, the plurality of circuits includes a first circuit in fluid communication with the first cavity and a third circuit in fluid communication with the second cavity. In another embodiment, the plurality of circuits includes a second circuit in fluid communication with the first cavity. In yet another embodiment, the plurality of circuits includes a second circuit in fluid communication with the second cavity.

Another aspect of the present disclosure is directed to a heat engine. The heat engine includes a first cooling fluid source configured to provide a first cooling fluid; a second cooling fluid source configured to provide a second cooling fluid, wherein the first cooling fluid and the second cooling fluid each define one or more of a different pressure or temperature relative to one another; and a rotor assembly including an airfoil assembly and a hub to which the airfoil assembly is attached. The rotor assembly defines a first cavity and a second cavity between the airfoil assembly and the hub at least partially fluidly separates the first cavity from the second cavity. The first cavity is in fluid communication with the first cooling fluid source to receive the first cooling fluid. The second cavity is in fluid communication with the second cooling fluid source to receive the second cooling fluid.

In various embodiments, the heat engine further includes a first static assembly disposed directly adjacent to the rotor assembly. The first cooling fluid source is disposed at least partially through the first static assembly. The first cooling fluid source is configured to provide the first cooling fluid therethrough to the first cavity of the rotor assembly. The heat engine further includes a second static assembly disposed directly adjacent to the rotor assembly. The second cooling fluid source is disposed at least partially through the second static assembly. The second cooling fluid source is configured to provide the second cooling fluid therethrough to the second cavity of the rotor assembly.

In one embodiment, the rotor assembly includes a wall defining a first plenum fluidly separated from a second plenum. The first plenum is in fluid communication with the first cavity. The second plenum is in fluid communication with the second cavity.

In another embodiment, the wall assembly is extended from a base portion of the airfoil assembly and the hub to define a seal assembly defining the first cavity and the second cavity between the airfoil assembly and the hub.

In yet another embodiment, the wall assembly is extended from the airfoil assembly between the rotor assembly and one or more of the first static assembly or the second static assembly to define one or more of the first plenum or the second plenum therewithin.

In one embodiment, the rotor assembly defines a first inlet opening through the base portion in fluid communication with the first cavity.

In various embodiments, the rotor assembly includes a plurality of circuits through the airfoil assembly in fluid communication with one or more of the first cavity and the second cavity. In one embodiment, the plurality of circuits through the rotor assembly includes a first circuit in fluid communication with the first cavity and a third circuit in fluid communication with the second cavity. In another embodiment, the plurality of circuits through the rotor assembly includes a second circuit in fluid communication with the first cavity. In yet another embodiment, the plurality of circuits includes a second circuit in fluid communication with the second cavity.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
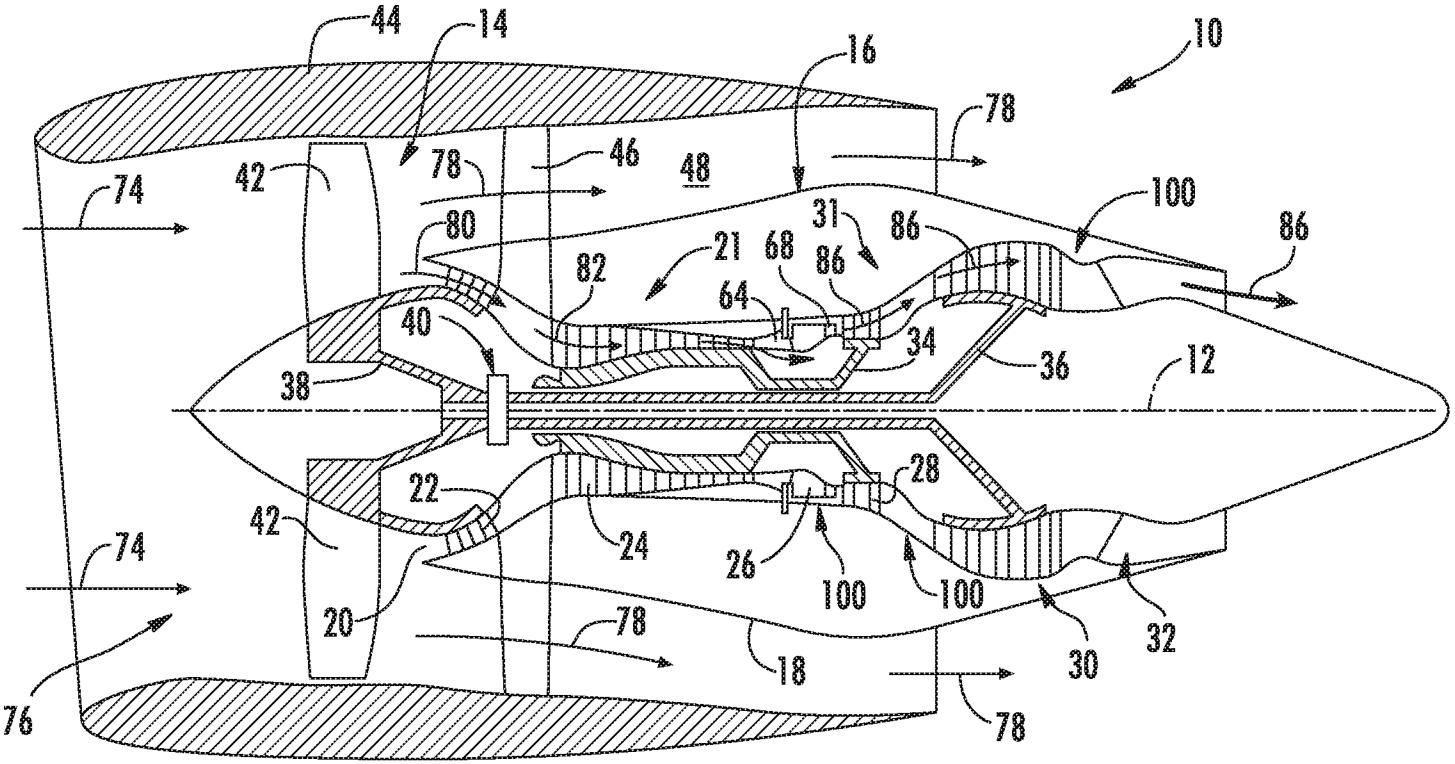
FIG. 1 is a schematic cross sectional view of an exemplary heat engine including a rotor assembly according to aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of an engine including a rotor assembly and airfoil assembly are generally provided that may improve provision of cooling fluid to rotor blades while mitigating losses and inefficiencies at the engine related to providing cooling fluid. Embodiments shown and described herein include providing two or more cooling fluids of different pressure and/or temperatures to forward and aft portions of the rotor assembly. The different cooling fluids may generally include a cooled cooling air (CCA) circuit such as to pass compressor section air through one or more heat exchangers and through a static structure such as to provide cooling fluid to the airfoil assembly of the rotor assembly. The other fluid may generally include a higher pressure and/or higher temperature source, such as routed through the combustion section. The separate flows of cooling fluid reduce the overall flow of cooling fluid extracted from the aerodynamic and thermodynamic cycle of the engine via reducing the flow extracted through the combustion section and providing a reduced flow of lower temperature cooling fluid through the rotor assembly.

Referring now to the drawings, FIG. 1 is a schematic partially cross-sectioned side view of an exemplary heat engine 10 herein referred to as "engine 10" as may incorporate various embodiments of the present disclosure. Although further described below with reference to a gas turbine engine, the present disclosure is also applicable to turbomachinery in general, including gas turbine engines defining turbofan, turbojet, turboprop, and turboshaft gas turbine engines, including marine and industrial turbine engines and auxiliary power units, and steam turbine engines, internal combustion engines, reciprocating engines, and Brayton cycle machines generally. As shown in FIG. 1, the engine 10 has a longitudinal or axial centerline axis 12 that extends there through for reference purposes. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section 21 having a booster or low pressure (LP) compressor 22, a high pressure (HP) compressor 24, a combustor-diffuser assembly 26, a turbine section 31 including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

It should be appreciated that the HP turbine 28, the HP shaft 34, and the HP compressor 24 together may define a rotor assembly 90 of the engine 10 rotatable relative to the centerline axis 12. In other embodiments, the rotor assembly 90 further described herein may include the LP turbine 30, the LP shaft 36, and the LP compressor 22 together, or, alternatively, including the fan shaft 38. In still other embodiments not depicted, the rotor assembly 90 may include an intermediate pressure turbine, shaft, and compressor assembly.

During operation of the engine 10, a volume of oxidizer as indicated schematically by arrows 74 enters the engine 10 through an associated inlet 76 of the nacelle 44 and/or fan assembly 14. As the oxidizer 74 passes across the fan blades 42 a portion of the oxidizer as indicated schematically by arrows 78 is directed or routed into the bypass airflow passage 48 while another portion of the oxidizer as indicated schematically by arrow 80 is directed or routed into the LP compressor 22. Oxidizer 80 is progressively compressed as it flows through the LP and HP compressors 22, 24 towards the combustion section 26.

Combustion gases 86 generated at the combustion section 26 flow into the turbine section 31, such as to the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Figure 2:
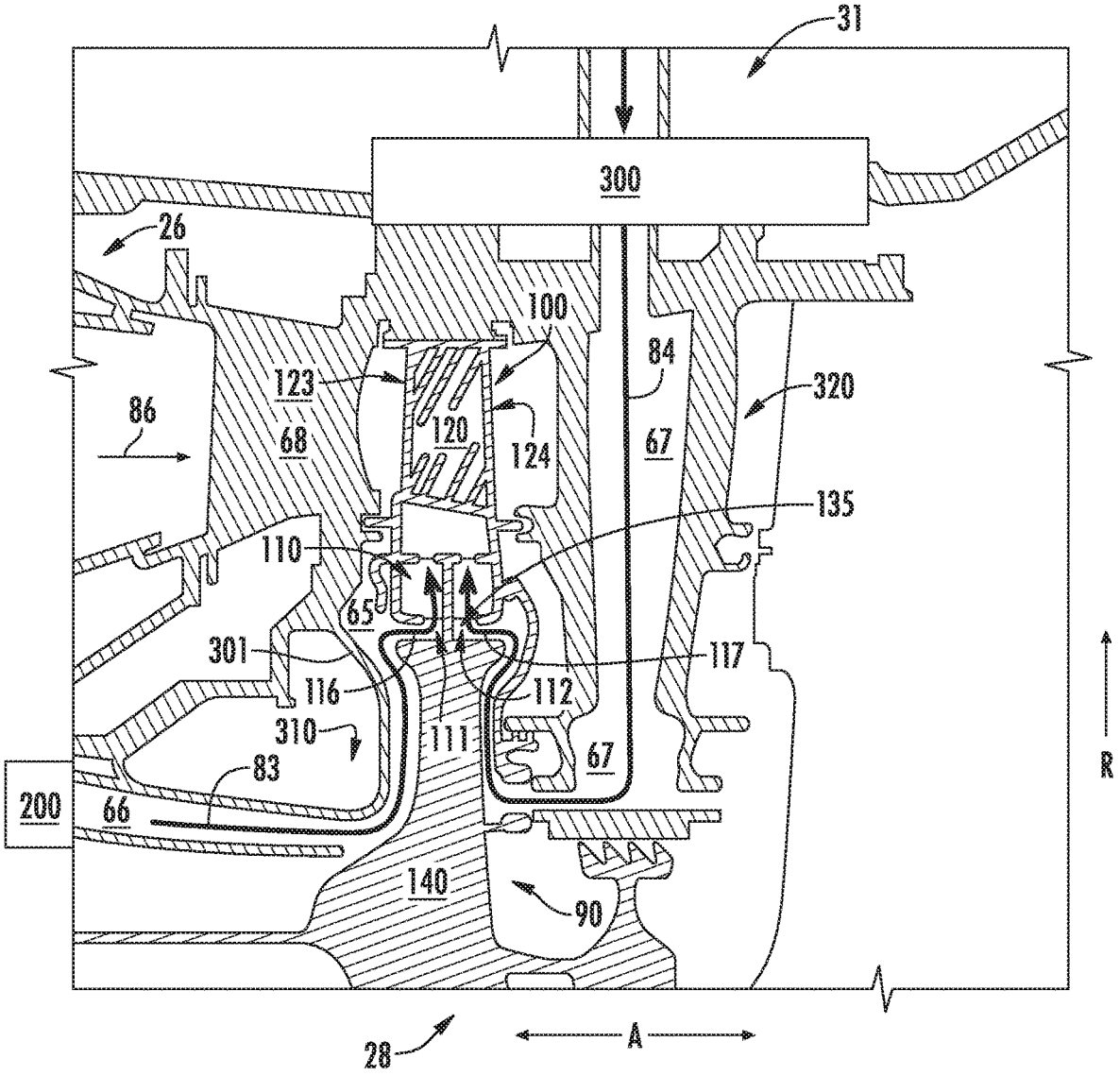
FIG. 2 is a schematic cross sectional view of an exemplary portion of a turbine section and combustion section of the engine of FIG. 1.

Typically, the LP and HP compressors 22, 24 provide more oxidizer to the combustion section 26 than is utilized for producing combustion gases 86. Therefore, a portion of the oxidizer 82 as indicated schematically by arrows 83 may be used as a first cooling fluid. For example, as shown in FIG. 2, the first cooling fluid 83 may be routed through a first conduit 66 to provide thermal attenuation (e.g., heat transfer generally, or cooling specifically) to hotter portions of the rotor assembly 90, such as at the HP turbine 28 and/or LP turbine 30. In various embodiments, the first conduit 66 is defined at the combustion section 26 and/or turbine section 31, such as depicted in part at least at FIG. 2. The first conduit 66 may generally provide the first cooling fluid 83 via one or more walls 301 defining a passage 65 between the wall 301 and at least one component at the rotor assembly 90. The first conduit 66 is in fluid communication with a first cavity 116 (FIGS. 3-7) at the rotor assembly 90 such as to provide a flow of the first cooling fluid 83 to the rotor assembly 90 such as further described below in regard to FIGS. 3-12.

The engine 10 may generally include a first static assembly 310 disposed adjacent to the rotor assembly 90 along an axial direction A, such as directly forward of the rotor assembly 90. The first static assembly 310 may include the combustion section 26 upstream of the HP turbine 28 including the rotor assembly 90. Still further, the first static assembly 310 may define, at least in part, the first conduit 66 through which the first cooling fluid 83 from a first cooling fluid source 200 is provided to the first cavity 116 (FIGS. 3-7) of the rotor assembly 90.

Referring still to FIG. 2, the first cooling fluid 83 through the first conduit 66 may generally be provided by a first cooling fluid source 200 configured to provide the first cooling fluid 83. In various embodiments, the first cooling fluid source 200 may define one or more portions of the compressor section 21, such as form a compressor bleed at the LP compressor 22 or HP compressor 24. In one embodiment, the first cooling fluid source 200 is defined at the exit of the compressor section 21 (e.g., at the combustion section 26). In various embodiments, the first cooling fluid source 200 is defined from one or more stages within the compressor section 21 upstream of a compressor exit 64 (FIG. 1).

In various embodiments, the engine 10 further includes a second cooling fluid source 300 configured to provide a second cooling fluid from a portion of the flow of oxidizer 82, such as depicted via arrows 84. The second cooling fluid source 300 may additionally derive the second cooling fluid 84 from the compressor section 21. However, the second cooling fluid source 300 may further include one or more flow paths defining the second cooling fluid 84 of one or more of a different pressure or temperature relative to the first cooling fluid 83. In various embodiments, the second cooling fluid source 300 may further include one or more heat exchangers. For example, the second cooling fluid source 300 may provide the second cooling fluid 84 in thermal communication with one or more of a flow of bypass air (e.g., flow of oxidizer 78), a flow of liquid and/or gaseous fuel, a flow of lubricant, a flow of hydraulic fluid, a flow of cryogenic fluid, supercritical fluid, or other coolant or refrigerant, or other heat sink, such as to decrease the temperature of the second cooling fluid 84 relative to the flow of oxidizer 82.

The engine 10 may generally include a second static assembly 320 disposed adjacent to the rotor assembly 90 along the axial direction A, such as directly aft of the rotor assembly 90. The second static assembly 320 may include a portion of the HP turbine 28, such as a casing, frame, or vane assembly, downstream of one or more rotors of the turbine section 31. Still further, the second static assembly 320 may define, at least in part, a second passage 67 through which the second cooling fluid 84 from the second cooling fluid source 300 is provided to a second cavity 117 (FIGS. 3-7) of the rotor assembly 90, such as further described herein.

Figure 3:
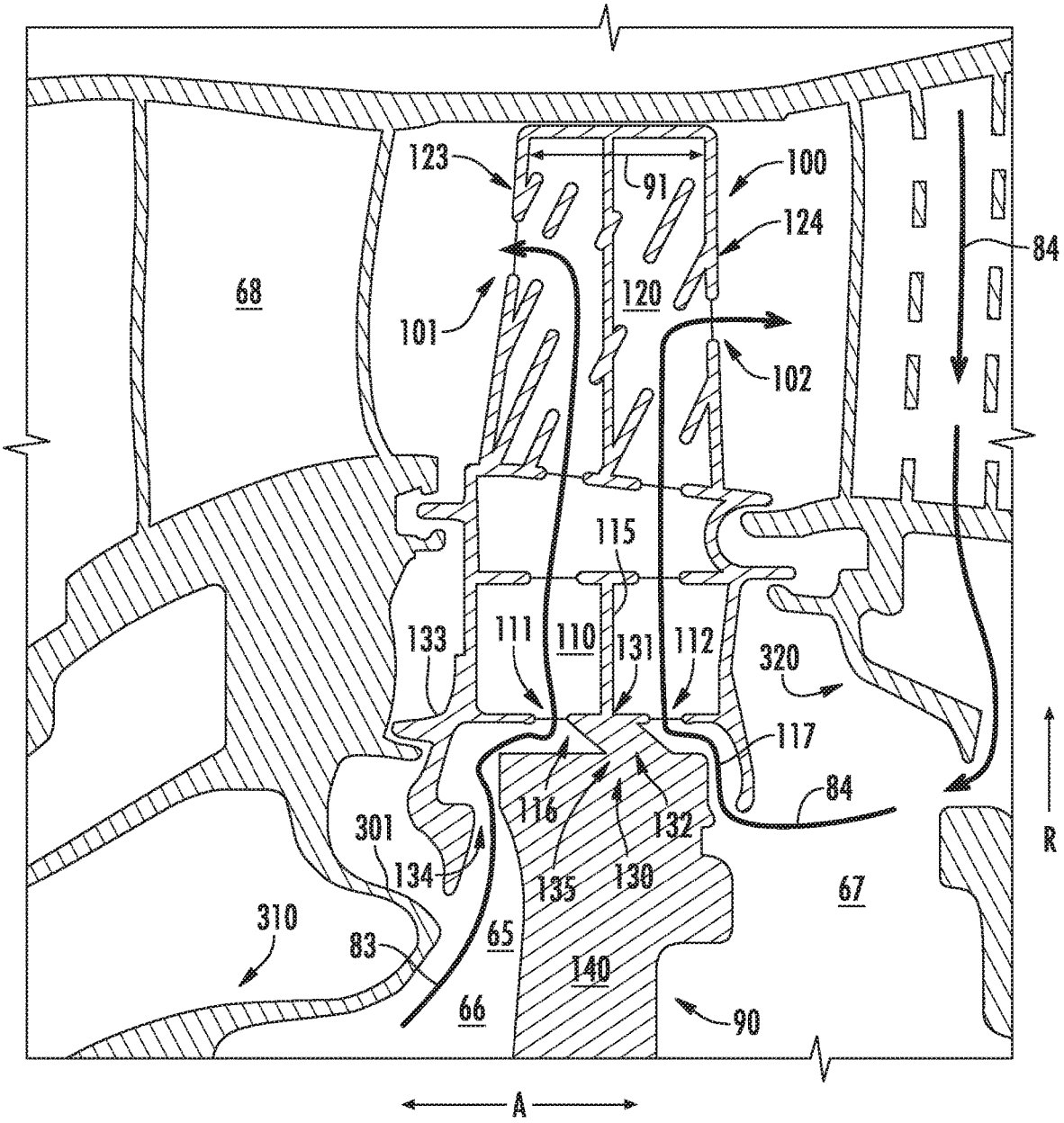
FIG. 3 is a detailed schematic cross sectional view of an exemplary embodiment of a portion of the turbine section and combustion section of FIG. 2.

Referring now to FIGS. 2-3, schematic cross sectional views of the engine 10 are generally provided. FIGS. 2-3 generally depict portions of the turbine section, such as the HP turbine 28, and an exit portion of the combustion section 26, such as at the turbine nozzle assembly 68. The engine 10 includes the rotor assembly 90 including an airfoil assembly 100 and a hub 140 to which the airfoil assembly 100 is attached. The airfoil assembly 100 includes a base portion 110 coupled to the hub 140. In various embodiments, the airfoil assembly 100 is detachably coupled to the hub 140. For example, the hub 140 may define a slot, such as a dovetail slot through which the airfoil assembly 100 may be detachably coupled. However, in other embodiments, the airfoil assembly 100 may be integral to the hub 140, such as defining an integrally bladed rotor or bladed disk.

Referring to FIG. 3, the rotor assembly 90 may include a seal assembly 130 extended from the base portion 110 of the airfoil assembly 100 to the hub 140. The seal assembly 130 defines a first cavity 116 and a second cavity 117 separated from one another by the seal assembly 130. In various embodiments, the first cavity 116 and the second cavity 117 are defined collectively by the hub 140, the base portion 110, and the seal assembly 130. The seal assembly 130 fluidly separates the first cavity 116 and the second cavity 117 between the airfoil assembly 100 and the hub 140. For example, the seal assembly 130 enables the fluidly separate flows of cooling fluids 83, 84 to enter into the base portion 110 of the airfoil assembly 100 from their respective cavities 116, 117, such as further depicted in regard to FIGS. 8-12. In various embodiments, the seal assembly 130 may define a labyrinth seal, a brush seal, a leaf seal, a foil or other single or multi-walled seal, or other appropriate sealing arrangement.

In various embodiments, the seal assembly 130 includes a wall assembly 135 coupled to the rotor assembly 90. The wall assembly 135 is coupled to airfoil assembly 100 and extended therefrom to fluidly separate the flows of cooling fluid 83, 84 from one another. Referring to FIG. 3, in one embodiment, the seal assembly 130 including the wall assembly 135 is coupled to the base portion 110 of the airfoil assembly 100. The wall assembly 135 defines the first cavity 116 fluidly segregated from the second cavity 117. It should be appreciated that the seal assembly 130 separates or disconnects fluid flow between the first cavity 116 and the second cavity 117. However, in various embodiments, a quantity of flow may flow between the first cavity 116 and the second cavity 117.

Figure 4:
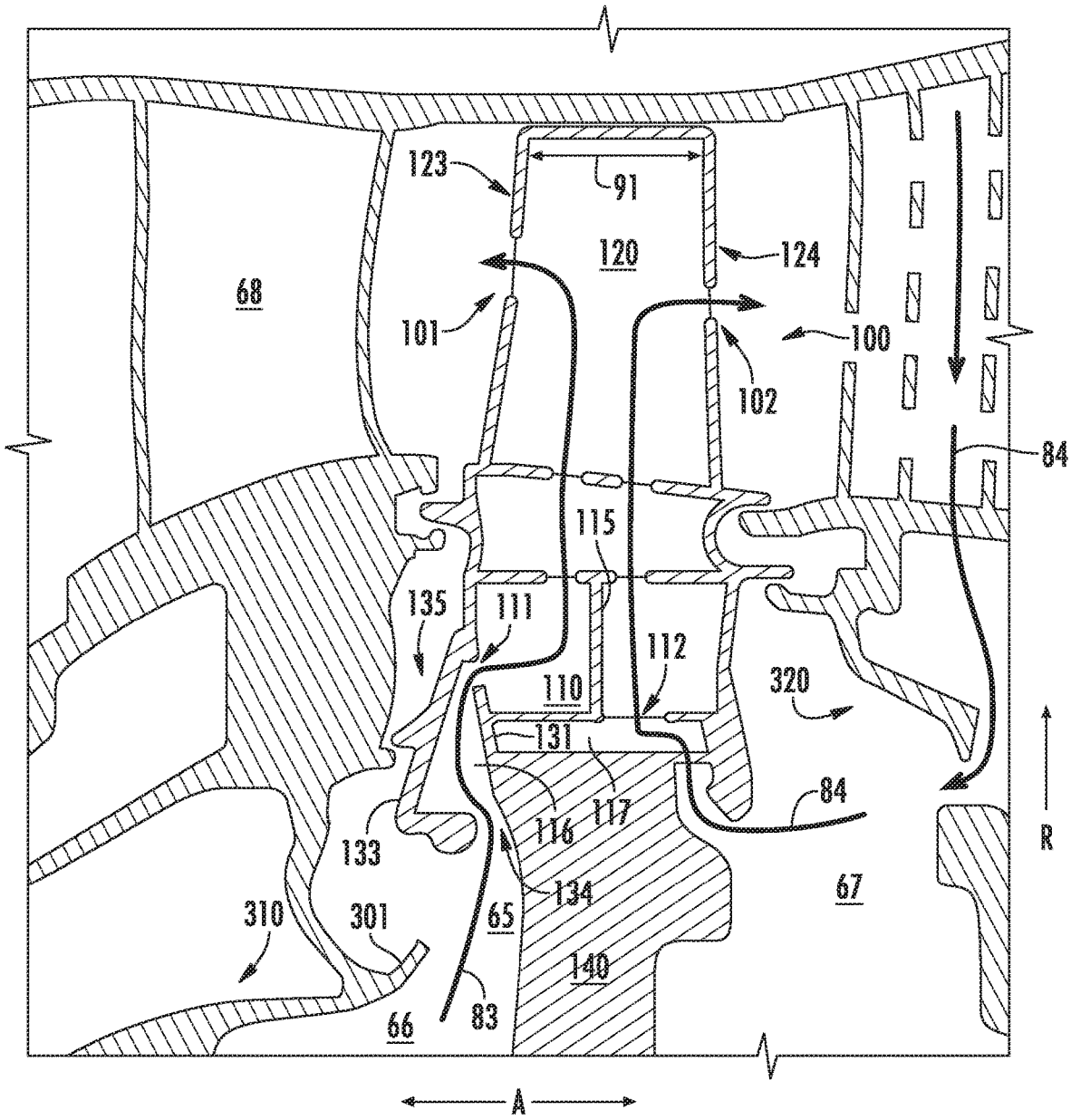
FIG. 4 is a detailed schematic cross sectional view of another exemplary embodiment of a portion of the turbine section and combustion section of FIG. 2.

In various embodiments, such as depicted in regard to FIGS. 3-4, the wall assembly 135 includes a first wall 131 extended from the base portion 110 of the airfoil assembly 100 and in contact with the hub 140. In another embodiment, such as depicted in regard to FIG. 3, the wall assembly 135 further includes a second wall 132 extended from the hub 140 in contact with the base portion 110 of the airfoil assembly 100. The first wall 131 and the second wall 132 are in direct adjacent arrangement such as to provide a sealing arrangement fluidly disconnecting the first cavity 116 and the second cavity 117. For example, the first wall 131 and the second wall 132 may each be in direct adjacent arrangement along a chordwise direction 91 (FIG. 3) relative to the airfoil assembly 100. The seal assembly 130 may further include an alternating plurality of the first wall 131 and the second wall 132 such as to define cavities therebetween to limit flow or fluid communication between the first cavity 116 and the second cavity 117.

Referring back to FIG. 3, in various embodiments, the seal assembly 130 defines the first cavity 116 between the base portion 110 and the hub 140 along the radial direction R. In another embodiment, the seal assembly 130 defines the second cavity 117 between the base portion 110 and the hub 140 along the radial direction R. In still various embodiments, a first inlet opening 111 and a second inlet opening 112 are each separated by the seal assembly 130 therebetween. In various embodiments, the first inlet opening 111 and the second inlet opening 112 are separated by the seal assembly 130 along the chordwise direction 91 corresponding to the axial direction A of the engine 10. In one embodiment, the base portion 110 defines the first inlet opening 111 in direct fluid communication with the first cavity 116. In another embodiment, the second inlet opening 112 is defined in direct fluid communication with the second cavity 117.

Referring now to FIG. 4, another exemplary embodiment of the engine 10 is generally provided. The embodiment provided in regard to FIG. 4 is configured substantially similarly are shown and described in regard to FIGS. 2-3. In still various embodiments, the wall assembly 135 further includes a third wall 133 extended from the airfoil assembly 100. In one embodiment, the third wall 133 is extended from a forward end corresponding to a leading edge 123 of the airfoil assembly 100. In another embodiment, the third wall 133 may be extended from an aft end corresponding to a trailing edge 124 of the airfoil assembly 100. In one embodiment, the first cavity 116 is defined between the third wall 133 and the first wall 131 extended between the airfoil assembly 100 and the hub 140.

In still various embodiments, the third wall 133 may be extended from the airfoil assembly 100, such as the base portion 110 thereof, within the passage 65 defined between the rotor assembly 90 and the first static assembly 310. In another embodiment, the third wall 133 may be extended from an aft end of the rotor assembly 90, such as to extend within the second passage 67 between the second static assembly and the aft side of the rotor assembly 90. In various embodiments, the third wall 133 may define an opening 134 between the third wall 133 and the rotor assembly 90. In one embodiment, the opening 134 between the third wall 133 and the rotor assembly 90 may be defined between the hub 140 of the rotor assembly 90 and the third wall 133. In various embodiments, the third wall 133 extends radially inward toward the hub 140 to define the opening 134 between the third wall 133 and the rotor assembly 90 such as to admit the flow of cooling fluid therethrough to the airfoil assembly 100.

In various embodiments, the base portion 110 defines a first inlet opening 111 in fluid communication with the first cavity 116. In one embodiment, the first inlet opening 111 is defined through the forward end of the airfoil assembly 100 in fluid communication with the first cavity 116.

Figure 5:
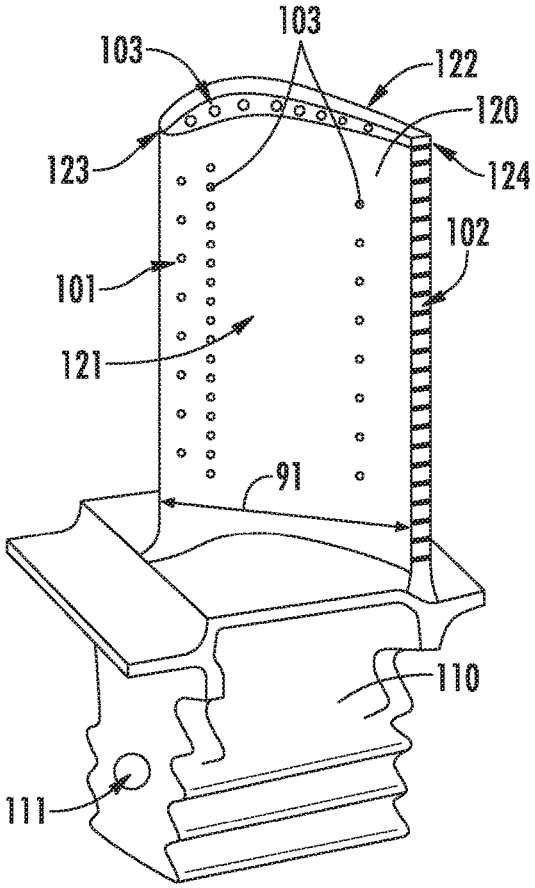
FIG. 5 is a perspective view of an exemplary embodiment of an airfoil assembly of the rotor assembly depicted in regard to FIGS. 1-4.
Figure 6:
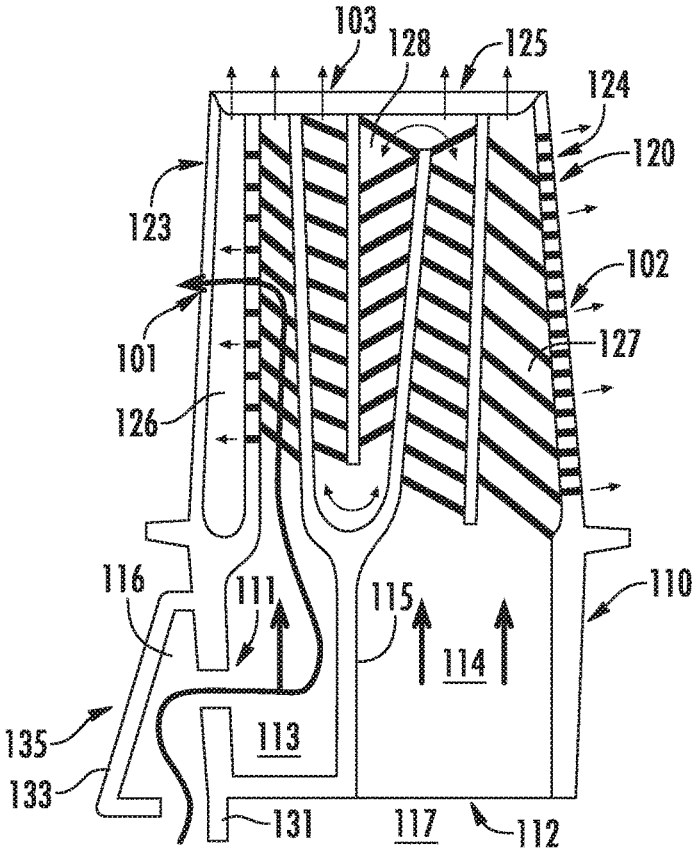
FIG. 6 is a cross sectional view of an exemplary embodiment of the airfoil assembly of FIG. 5.
Figure 7:
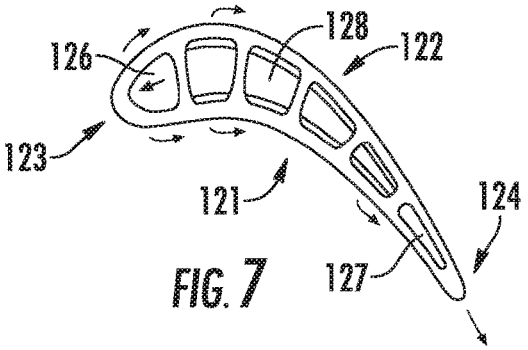
FIG. 7 is another cross sectional view of an exemplary embodiment of the airfoil assembly of FIG. 5.

Referring now to FIGS. 5-7, detailed exemplary embodiments of the airfoil assembly 100 are provided. FIG. 5 provides a perspective view of an exemplary embodiment of the airfoil assembly 100. FIG. 6 provides a cross sectional view of the exemplary airfoil assembly 100 of FIG. 5. FIG. 7 provides a top-down view of the exemplary embodiment of the airfoil assembly 100 provided in regard to FIGS. 5-6. Referring collectively to FIGS. 5-7, the airfoil assembly 100 defines a pressure side 121, a suction side 122, a leading edge 123, and a trailing edge 124.

Referring to FIGS. 5-7, in various embodiments, the base portion 110 of the airfoil assembly 100 includes a base portion wall 115 disposed within the base portion 110. The base portion wall 115 defines a first plenum 113 and a second plenum 114 separated from one another by the base portion wall 115. In one embodiment, the first plenum 113 in the base portion 110 is in fluid communication with the first cavity 116. In another embodiment, the second plenum 114 in the base portion 110 is in fluid communication with the second cavity 117.

In various embodiments, the airfoil assembly 100 further includes an airfoil structure 120 extended along the radial direction R from the base portion 110 and attached to the base portion 110. For example, the airfoil structure 120 and the base portion 110 may be integrally formed together as the airfoil assembly 100 (e.g., casting, forging, machined, additive manufactured, etc., or combinations thereof). The airfoil assembly 100 defines a plurality of circuits 126, 127, 128, 129 in fluid communication with one or more of the first plenum 113 and the second plenum 114. In various embodiments, the airfoil assembly 100 defines a first circuit 126 disposed in thermal communication at least at the leading edge 123 of the airfoil assembly 100. In still various embodiments, the airfoil assembly 100 defines a second circuit 127 disposed in thermal communication at least at the trailing edge 124 of the airfoil assembly 100. In another embodiment, the airfoil assembly 100 defines one or more of a third circuit 128 disposed between the first circuit 126 and the second circuit 127 along the chordwise direction 91. It should be appreciated that in various embodiments, the airfoil assembly 100 may define a plurality of the first circuit 126, the second circuit 127, or the third circuit 128.

In one embodiment, the airfoil assembly 100 defines the first circuit 126 in fluid communication with a first opening 101. In another embodiment, the airfoil assembly 100 defines the second circuit 127 in fluid communication with a second opening 102. The first circuit 126 and the second circuit 127 each extend at least partially through the airfoil structure 120.

Referring still to FIGS. 5-7, in various embodiments, the airfoil assembly 100 further defines the third circuit 128 between the first circuit 126 and the second circuit 127 along the chordwise direction 91. In still various embodiments, the third circuit 128 is in fluid communication with the first plenum 113. In still yet various embodiments, the third circuit 128 defines a substantially serpentine passage or conduit through the airfoil structure 120, such as to provide cooling between the leading edge 123 and the trailing edge 124 of the airfoil structure 120.

In one embodiment, the first opening 101 may be disposed at the leading edge 123 of the airfoil structure 120. In another embodiment, the second opening 102 may be disposed at the trailing edge 124 of the airfoil structure 120. In still other embodiments, such as generally depicted in regard to FIG. 5, the airfoil structure 120 may define a third opening 103 through one or more of the pressure side 121, the suction side 122, a radially outward tip 125 (FIG. 6), or combinations thereof, of the airfoil structure 120. In various embodiments, one or more of the first circuit 126, the second circuit 127, or the third circuit 128 may be in fluid communication with the third opening 103.

In various embodiments, the first circuit 126 may extend at the leading edge 123 of the airfoil assembly 100 and further fluidly couple to the second circuit 127 at the trailing edge 124, the third circuit 128 between the leading edge 123 and the trailing edge 124, or both, via a connecting circuit 129 (FIGS. 8-12). The first circuit 126 may be in fluid communication with one or more of the first opening 101, the second opening 102, or the third opening 103, or combinations thereof. In other embodiments, the second circuit 127 may extend at the trailing edge 124 of the airfoil assembly 100 and further fluidly couple to the first circuit 126 at the leading edge 123, the third circuit 128 therebetween, or both, via the connecting circuit 129 (FIGS. 8-12). The second circuit 127 may be in fluid communication with one or more of the first opening 101, the second opening 102, or the third opening 103, or combinations thereof.

Referring now to FIGS. 8-12, schematic cross sectional views of the airfoil assembly 100 are generally provided. The embodiments provided in regard to FIGS. 8-12 are configured substantially similarly as shown and described in regard to FIGS. 1-7. It should be appreciated that one or more walls, plenums, cavities, etc. such as generally depicted in regard to FIG. 6 may be incorporated to define the plurality of circuits 126, 127, 128, 129 such as schematically depicted in regard to FIGS. 8-12.

Figure 8:
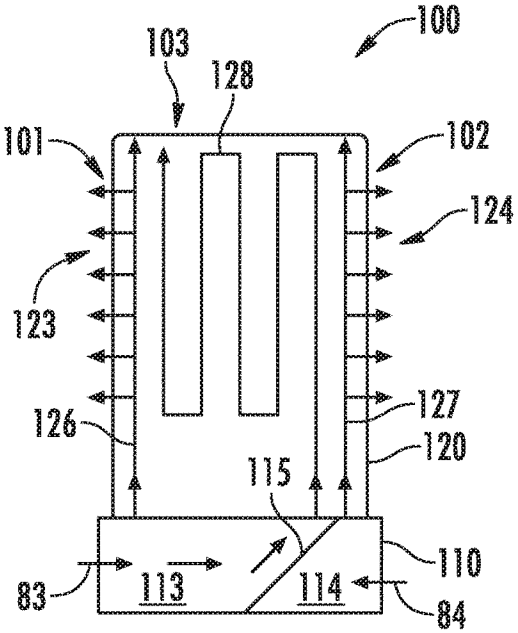
FIG. 8 is a schematic cross sectional view of an exemplary embodiment of the airfoil assembly of FIGS. 5-7.

Referring to FIG. 8, in one embodiment the first circuit 126 and the third circuit 127 are each in fluid communication with the first plenum 113. The first plenum 113 receives the flow of first cooling fluid 83 from the first cavity 116 and first conduit 66, such as described in regard to FIGS. 2-4. The embodiment provided in regard to FIG. 8 may provide cooling to the leading edge 123 of the airfoil structure 120 via the first cooling fluid 83 defining a higher temperature and/or pressure relative to the second cooling fluid 84. Additionally, the second circuit 127 is in fluid communication with the second plenum 114 to receive the flow of second cooling fluid 84 from the second cavity 117. Additionally, or alternatively, the embodiment provided in regard to FIG. 8 may provide cooling to the trailing edge 124 of the airfoil structure 120 via the second cooling fluid 84 defining a lower pressure and/or temperature relative to the first cooling fluid 83. As yet another example, the embodiment provided in regard to FIG. 8 may improve engine efficiency via reducing the amount of cooling flow extracted from a relatively higher pressure and higher temperature source, such as the first cooling fluid source 200 at the compressor exit 64 (e.g., temperature and pressure at the combustion section 26 at the compressor exit 64).

Figure 10:
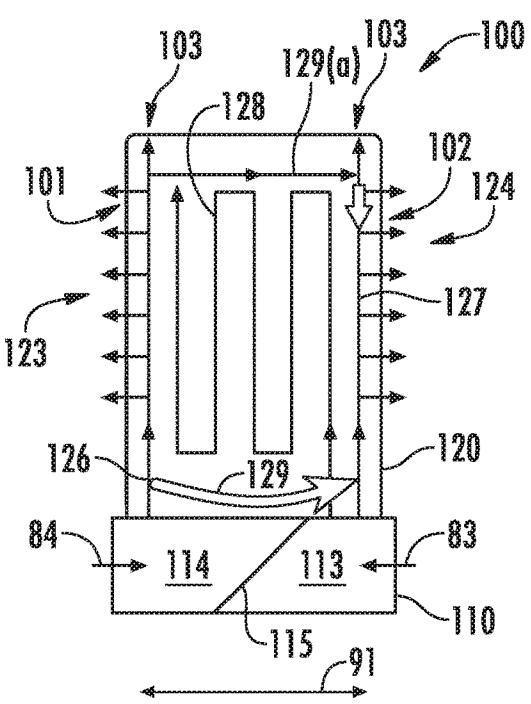
FIG. 10 is a schematic cross sectional view of yet another exemplary embodiment of the airfoil assembly of FIGS. 5-7.
Figure 9:
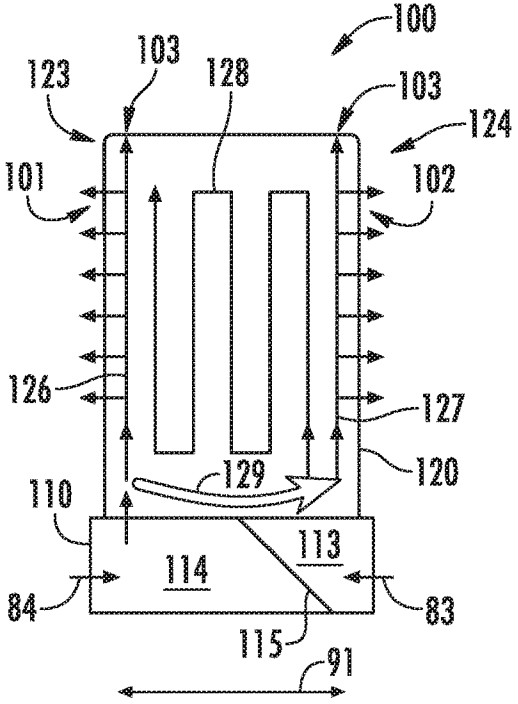
FIG. 9 is a schematic cross sectional view of another exemplary embodiment of the airfoil assembly of FIGS. 5-7.
Figure 11:
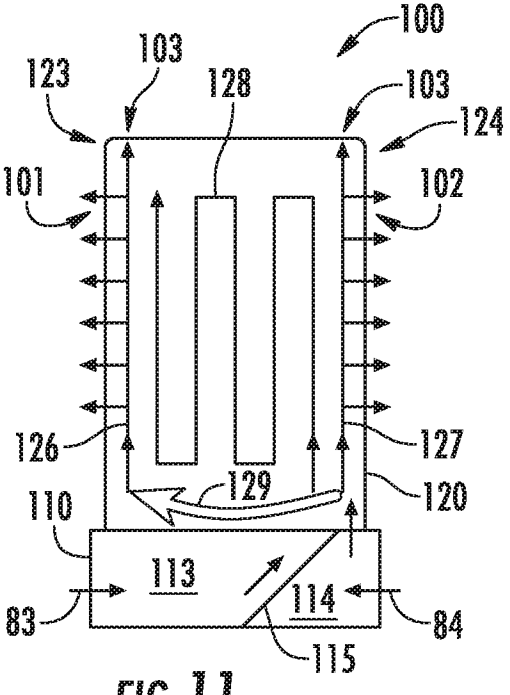
FIG. 11 is a schematic cross sectional view of still another exemplary embodiment of the airfoil assembly of FIGS. 5-7.

Referring now to FIGS. 9-11, in various embodiments the first circuit 126 and the second circuit 127 are each in fluid communication with the second plenum 114. The first circuit 126 and the second circuit 127 are coupled together in fluid communication via a connecting circuit 129. In one embodiment, the connecting circuit 129 extends across the chordwise direction 91 of the airfoil structure 120 to couple the first circuit 126 and the second circuit 127 in fluid communication. In various embodiments, the connecting circuit 129 is defined within the airfoil structure 120 to couple a plurality of chambers, cavities, etc. of a plurality of the first circuit 126, the second circuit 127, or the third circuit 128. In one embodiment, the connecting circuit 129 is defined fluidly separate from the third circuit 128, such as to provide the flow of second cooling fluid 84 to the leading edge 123 and the trailing edge 124 of the airfoil structure 120. The third circuit 128 is in fluid communication with the first plenum 113. In various embodiments, the third circuit 128 is fluidly separate or disconnected from the first circuit 126 and the second circuit 127 such as to provide the flow of first cooling fluid 83 through the airfoil structure 120 between the leading edge 123 and the trailing edge 124.

Referring particularly to FIG. 10, in one embodiment, the connecting circuit 129 is defined at a radially inward or root portion of the airfoil assembly 100. In one embodiment, the connecting circuit 129 is disposed in the base portion 110 of the airfoil assembly 100. In various embodiments, the connecting circuit 129 is disposed in the airfoil structure 120 of the airfoil assembly 100. In another embodiment, the airfoil structure 120 further includes a second connecting circuit 129(*a*) defined at a radially outward or tip portion of the airfoil structure 120. In various embodiments, the airfoil structure 120 may define one or more of the connecting circuits 129, 129(*a*) disposed at a root portion, a tip portion, or radially therebetween through the airfoil structure 120.

Referring to FIGS. 9-10, the second plenum 114 may be disposed forward (e.g., corresponding to the leading edge 123) within the airfoil assembly 100 and the first plenum 113 may be disposed aft (e.g., corresponding to the trailing edge 124) of the second plenum 114, in which each plenum is separated by the base portion wall 115. The flow of second cooling fluid 84 may be received at the second plenum 114 and routed aft through the airfoil assembly 100 from the first circuit 126. The flow of second cooling fluid 84 may be received at the second plenum 114 and routed aft through the airfoil assembly 100 from the first circuit 126 to the second circuit 127.

Referring to FIG. 11, the first plenum 113 may be disposed forward (e.g., corresponding to the leading edge 123) within the airfoil assembly 100 and the second plenum 114 may be disposed aft (e.g., corresponding to the trailing edge 124) of the first plenum 113, in which each plenum is separated by the base portion wall 115. The flow of second cooling fluid 84 may be received at the second plenum 114 and routed forward through the airfoil assembly 100 from the second circuit 127 to the first circuit 126.

Referring to FIGS. 9-11, the flow of second cooling fluid 84 to the leading edge 123 and the trailing edge 124, and the flow of first cooling fluid 83 therebetween along the chordwise direction 91, enables providing a lower temperature and/or lower pressure source of cooling fluid to portions of the airfoil structure 120 that may be more prone to deterioration and damage due to combustion gases. Additionally, or alternatively, the lower temperature and/or lower pressure second cooling fluid 84 from the second cooling fluid source 300 enables reduced flow rates such as to reduce blockage at the exit of the compressor section 21 or at the combustion section 26.

Figure 12:
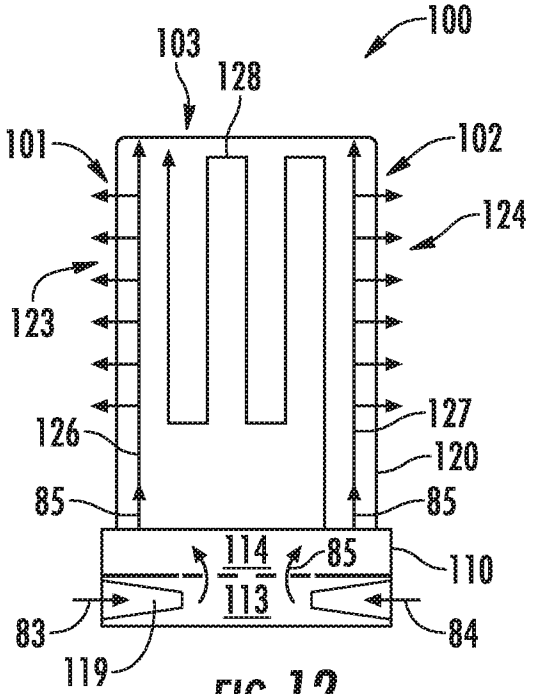
FIG. 12 is a schematic cross sectional view of still yet another exemplary embodiment of the airfoil assembly of FIGS. 5-7.

Referring to FIG. 12, in another embodiment the airfoil assembly 100 may include the first plenum 113 in the base portion 110 in fluid communication with the first cavity 116 and the second cavity 117 such as to define the first plenum 113 as a mixing chamber in fluid communication with the first cavity 116 and the second cavity 117. The airfoil assembly 100 may further include the second plenum 114 in fluid communication with the first plenum 113. In various embodiments, the base portion wall 115 may define one or more base portion apertures 118 through the base portion wall 115 such as to receive the combined flow of fluid 85 from the first plenum 113 into the second plenum 114. The combined flow of fluid 85 includes the first cooling fluid 83 and the second cooling fluid 84 mixed at the first plenum 113 defining a mixing chamber.

In still various embodiments, the airfoil assembly 100 may include at the base portion 110 a mixer assembly 119 to promote mixing of the first cooling fluid 83 with the second cooling fluid 84. For example, the mixer assembly 119 may define a swirler, a sparger device, a nozzle, etc. to condition the flows of fluid 83, 84 into the first plenum 113 defining a mixing chamber to promote mixing to provide the combined flow of fluid 85 to the second plenum 114. The second plenum 114 may further be fluid communication with the first circuit 126, the second circuit 127, and the third circuit 128 to provide the combined flow of fluid 85 through the leading edge 123, the trailing edge 124, and portions therebetween of the airfoil structure 120.

Portions of the engine 10, such as the rotor assembly 90 and the airfoil assembly 100 depicted in regard to FIGS. 1-12 and described herein, may be constructed as an assembly of various components that are mechanically joined or arranged such as to produce the embodiments of the rotor assembly 90 and the airfoil assembly 100 shown and described herein. The rotor assembly 90 and the airfoil assembly 100, separately or together, may alternatively each or collectively be constructed as a single, unitary component and manufactured from any number of processes commonly known by one skilled in the art. For example, the rotor assembly 90 and the airfoil assembly 100 may be constructed as a single, unitary component. These manufacturing processes include, but are not limited to, those referred to as "additive manufacturing" or "3D printing". Additionally, any number of casting, machining, welding, brazing, or sintering processes, or mechanical fasteners, or any combination thereof, may be utilized to construct the rotor assembly 90 and the airfoil assembly 100. Furthermore, the rotor assembly 90 and the airfoil assembly 100 may be constructed of any suitable material for turbine engine rotor assemblies and airfoil assemblies, or more specifically high pressure or low pressure turbine rotor assemblies, including but not limited to, nickel- and cobalt-based alloys. Still further, flowpath surfaces and passages may include surface finishing or other manufacturing methods to reduce drag or otherwise promote fluid flow, such as, but not limited to, tumble finishing, barreling, rifling, polishing, or coating.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A rotor assembly for a turbine engine, the rotor assembly defining a radial direction and comprising:

an airfoil assembly and a hub to which the airfoil assembly is attached, wherein a wall assembly defines a first cavity and a second cavity between the airfoil assembly and the hub, wherein the first cavity and the second cavity are at least partially fluidly separated by the wall assembly, wherein the first cavity is in fluid communication with a flow of first cooling fluid and the second cavity is in fluid communication with a flow of second cooling fluid different from the first cooling fluid, wherein the second cavity is formed between the hub and the airfoil assembly, wherein a first inlet opening is formed in fluid communication with the first cavity, wherein a second inlet opening is formed in fluid communication with the second cavity, and wherein the airfoil assembly is structured such that each of the flow of the first cooling fluid and the second cooling fluid enters the airfoil assembly from an innermost surface of the airfoil assembly in the radial direction.

2. The rotor assembly of claim 1, wherein the wall assembly is extended from the airfoil assembly or the hub to define a seal assembly defining the first cavity and the second cavity.

3. The rotor assembly of claim 1, wherein the wall assembly is extended from the airfoil assembly between a static assembly and the rotor assembly to define a plenum therewithin in fluid communication with one or more of the first cavity or the second cavity.

4. The rotor assembly of claim 1, wherein the rotor assembly comprises a base portion wall within the airfoil assembly defining a first plenum fluidly separated from a second plenum.

5. The rotor assembly of claim 4, wherein the first plenum is in fluid communication with the first cavity, and wherein the second plenum is in fluid communication with the second cavity.

6. The rotor assembly of claim 1, wherein the first inlet opening is formed through a base portion of the airfoil assembly in fluid communication with the first cavity.

7. The rotor assembly of claim 1, wherein the airfoil assembly comprises a plurality of circuits in fluid communication with one or more of the first cavity and the second cavity.

8. The rotor assembly of claim 7, wherein the plurality of circuits comprises a first circuit in fluid communication with the first cavity and a third circuit in fluid communication with the second cavity.

9. The rotor assembly of claim 8, wherein the plurality of circuits comprises a second circuit in fluid communication with the first cavity.

10. The rotor assembly of claim 8, wherein the plurality of circuits comprises a second circuit in fluid communication with the second cavity.

11. A heat engine, the heat engine comprising:

a first cooling fluid source configured to provide a first cooling fluid;

a second cooling fluid source configured to provide a second cooling fluid, wherein the second cooling fluid source comprises a heat exchanger providing thermal communication of the second cooling fluid with one or more of a flow of bypass air, fuel, lubricant, or hydraulic fluid, and wherein the first cooling fluid and the second cooling fluid each define one or more of a different pressure or temperature relative to one another; and a rotor assembly defining a radial direction and comprising an airfoil assembly and a hub to which the airfoil assembly is attached, wherein the rotor assembly defines a first cavity and a second cavity between the airfoil assembly and the hub at least partially fluidly separating the first cavity from the second cavity, wherein the first cavity is in fluid communication with the first cooling fluid source to receive the first cooling fluid, wherein the second cavity is in fluid communication with the second cooling fluid source to receive the second cooling fluid, wherein the second cavity is formed between the hub and the airfoil assembly, wherein a first inlet opening is formed in fluid communication with the first cavity, wherein a second inlet opening is formed in fluid communication with the second cavity, and wherein the airfoil assembly is structured such that each of the flow of the first cooling fluid and the second cooling fluid enters the airfoil assembly from an innermost surface of the airfoil assembly in the radial direction.

12. The heat engine of claim 11, further comprising:

a first static assembly disposed directly adjacent to the rotor assembly, wherein the first cooling fluid source is disposed at least partially through the first static assembly, and wherein the first cooling fluid source is configured to provide the first cooling fluid therethrough to the first cavity of the rotor assembly; and a second static assembly disposed directly adjacent to the rotor assembly, wherein the second cooling fluid source is disposed at least partially through the second static assembly, and wherein the second cooling fluid source is configured to provide the second cooling fluid therethrough to the second cavity of the rotor assembly.

13. The heat engine of claim 12, wherein the rotor assembly comprises a base portion wall defining a first plenum fluidly separated from a second plenum, and wherein the first plenum is in fluid communication with the first cavity, and wherein the second plenum is in fluid communication with the second cavity.

14. The heat engine of claim 13, wherein the wall assembly is extended from a base portion of the airfoil assembly and the hub to define a seal assembly defining the first cavity and the second cavity between the airfoil assembly and the hub.

15. The heat engine of claim 12, wherein the wall assembly is extended from the airfoil assembly between the rotor assembly and one or more of the first static assembly or the second static assembly to define one or more of the first plenum or the second plenum therewithin.

16. The heat engine of claim 11, wherein the first inlet opening is formed through the base portion in fluid communication with the first cavity.

17. The heat engine of claim 11, wherein the rotor assembly comprises a plurality of circuits through the airfoil assembly in fluid communication with one or more of the first cavity and the second cavity.

18. The heat engine of claim 17, wherein the plurality of circuits through the rotor assembly comprises a first circuit in fluid communication with the first cavity and a third circuit in fluid communication with the second cavity.

19. The heat engine of claim 18, wherein the plurality of circuits through the rotor assembly comprises a second circuit in fluid communication with the first cavity.

20. The heat engine of claim 18, wherein the plurality of circuits comprises a second circuit in fluid communication with the second cavity.

21. The rotor assembly of claim 1, wherein the wall assembly is directly connected to an outer surface of the hub in the radial direction to segregate the first and second cooling fluids upstream of the first and second inlet openings with respect to the flow of the first and second cooling fluids.

22. The heat engine of claim 11, wherein the wall assembly is directly connected to an outer surface of the hub in the radial direction to segregate the first and second cooling fluids upstream of the first and second inlet openings with respect to the flow of the first and second cooling fluids.

* * * * *